US006924723B1

(12) United States Patent
Bouldin et al.

(10) Patent No.: US 6,924,723 B1
(45) Date of Patent: Aug. 2, 2005

(54) COOLING SYSTEM FOR MAGNETIC FIELD GENERATING DEVICE

(75) Inventors: Floyd E. Bouldin, Signal Mountain, TN (US); C. Douglas Williams, Signal Mountain, TN (US); Dwight Bouldin, Signal Mountain, TN (US)

(73) Assignee: EMF Therapeutics, Inc., McMinnville, TN (US)

( * ) Notice: Subject to any disclaimer, the term of this patent is extended or adjusted under 35 U.S.C. 154(b) by 0 days.

(21) Appl. No.: 10/419,472

(22) Filed: Apr. 21, 2003

Related U.S. Application Data

(63) Continuation of application No. 09/560,846, filed on Apr. 28, 2000, now abandoned.

(51) Int. Cl.[7] ..... H01F 5/00

(52) U.S. Cl. ..... 335/300; 335/299; 336/59; 336/60

(58) Field of Search ..... 335/216, 299, 335/300; 336/55–62

(56) References Cited

U.S. PATENT DOCUMENTS 2,340,727 A * 2/1944 Zelt ..... 336/59
2,560,926 A * 7/1951 Brownell ..... 336/59
2,975,227 A * 3/1961 Wiater et al. ..... 174/52.1
3,295,082 A 12/1966 Kustom et al.
5,880,661 A 3/1999 Davidson et al.
6,007,476 A 12/1999 Wascher et al.

* cited by examiner

*Primary Examiner*—Ramon M. Barrera
(74) *Attorney, Agent, or Firm*—Chambliss, Bahner & Stophel, PC

(57) ABSTRACT

A magnetic field generating device comprising a frame about which a current carrying coil of conductor is wound. The frame preferably includes spaced-apart side panels and an auxiliary supplementary cooling system panel. Each of the panels is configured with a plurality of spacers and/or perforations to facilitate and encourage the movement of air within the apparatus. The spacers are preferably provided on the interior surfaces of the primary panels to maintain the coil winding in a centered position therewith. Spacers may also be interpositioned between the various layers of the coil itself to enable airflow into and around the various coil layers. Of course, in the alternate embodiment a plurality of coils may be provided such that each individual layers or combination thereof may comprise an individual coil. The preferred frame includes a perforated panel, a substantially non-perforated panel, and a auxiliary supplementary cooling system panel to enable the airflow from within the air space itself interpositioned between the perforated panel and substantially non-perforated panel into the air space established by the auxiliary supplementary cooling system panel and the perforated panel prior to exit and expulsion to the outer atmosphere.

11 Claims, 6 Drawing Sheets

VIEW A-A

VIEW A-A

COOLING SYSTEM FOR MAGNETIC FIELD GENERATING DEVICE

CROSS-REFERENCE TO RELATED APPLICATION

This application is a continuation of the application entitled COOLING SYSTEM FOR MAGNETIC FIELD GENERATING DEVICE, which was filed on Apr. 28, 2000, now abandoned and assigned a Ser. No. 09/560,846.

BACKGROUND OF THE INVENTION

1. Field of the Invention

The present invention relates generally to magnetic field generating devices but more particularly to such devices incorporating a current carrying field coil which is known to generate heat during use, and, therefore, create a need for a cooling system and associated ductwork to remove unwanted heat from the system.

2. Description of the Related Art

It is well known that current-carrying wires have a tendency to generate heat due to the inherent resistance of the wire to carry the load current as well as other phenomenon known as "hysteresis". The ability of electric current to travel through a conductor is impeded by the inherent resistance of the material composition of the conductor. Thus, the resistance or the inverse of resistance which is referred to as impedance, is an inherent function of any particular conductor. For example, the resistance of copper conductors differs from that of aluminum and platinum.

A magnetic field generating device of the type found in the art to which the invention relates may include a frame portion about which a current carrying conductor is wound.

U.S. Pat. No. 5,880,661 granted to Davidson, et. al., on Mar. 9, 1999, is directed to a complex magnetic field generating device. The Davidson device incorporates a frame portion, a current carrying coil, and in at least one of the alternate embodiments, a plurality of permanent magnets underlying the wound coil. The complex magnetic field generating device found in the Davidson patent is known to generate substantial amounts of heat during use. The air space between the raceway cover and the current carrying coil of the Davidson apparatus is deemed to be inadequate by itself to allow proper cooling of the coil during use at various given amperage levels.

U.S. Pat. No. 6,007,476 granted to Wascher, et. al., on Dec. 28, 1999, is directed to a non-particle, non-photonic device and method for effecting angiogenesis. The Wascher, et. al., device also includes a current carrying coil wound about a frame, and in some of its embodiments various permanent magnets underlie the coil. While it is believed to be superior in its cooling ability as compared to the Davidson device, it, too, has a tendency to generate significant amounts of heat during use at various elevated amperage levels.

It is desirable to provide a magnetic field generating device of the type including a frame and a current carrying coil of conductor, for example, wire wrapped about the frame to further include a cooling system to alleviate the heat generated by the apparatus during use.

It is further desirable to provide a device having the characteristics of a cooling system and further include its own ductwork and internal airflow diverters in association with the conductor coil.

SUMMARY OF THE INVENTION

An embodiment of the present invention is directed to a device for establishing or otherwise creating a substantially contained field having magnetic and electric components and wherein the device is configured with a cooling system to alleviate the heat generated by the current carrying coil during use. The field, however, may be associated with a current carrying coil, permanent magnets, or both in combination.

The preferred embodiment of the present invention includes a frame comprising spaced apart side panels joined together to form an annular platform onto which a coil of conductor may be wound. In addition, a supplemental panel associated with the ductwork of the cooling system of the present invention is also provided and is situated and attached adjacent to and substantially parallel with one of the aforementioned frame side panels.

The frame side panels are believed to be unique. One of the panels preferably includes a plurality of perforations to allow air to flow from the interior airspace where the coil is situated interpositioned between the spaced apart panels through the ductwork and air space situated between the supplementary cooling system panel and the perforated panel.

Hereinafter, the spaced apart frame panels will be referred to simply as a perforated panel and a non-perforated panel. The supplementary air duct panel is preferably positioned spaced apart from but adjacent to the perforated panel. The coil of conductor is wound about the annular portion interpositioned between the perforated and non-perforated panel.

In use, airflow is introduced into the air space above the coil situated between the perforated and non-perforated panels and is allowed to flow around the coil to move the heat away from the surface of the conductor and allow it to pass through the perforations of the perforated panel. The airflow passing through the perforated panel and entering the airspace interpositioned between the supplementary cooling system panel and the perforated panel is allowed to be vented to the exterior atmosphere.

A plurality of optional spacers are preferably provided on the inside surface of the perforated and non-perforated panels. The spacers help retain the coil in its installed, wound position and further provide a space between the coil and the various panels to allow for more efficient airflow across and over the wound conductor.

In addition, an optional plurality of heat-resistant coil separators are preferably positioned within the coil to elevate various layers of the wound coil above one another and therefore allow airflow therebetween. The airflow entering the coil in the air space above the coil and interpositioned between the perforated and non-perforated panels is, therefore, allowed to circulate between the layers of coil as they are held separate by the heat resistant coil separators. The heated air being moved from the conductor space passes through the perforated panel into the air space between the perforated and supplementary cooling system before being released to the external environment.

The present invention may be summarized in a variety of ways, one of which is the following: a magnetic field generating device comprising means for producing a magnetic field, wherein the means includes: a frame having a central passageway, a coil made of electrically conducting material wrapped about the frame and surrounding the central passageway; and a source of electrical energy for supplying an electrical current to the conducting material to create a magnetic field therefrom; and cooling means for cooling the coil during use.

The preferred frame further includes a cover attached to the frame to shield the coil, and a pair of spaced apart side panels configured to allow air to flow into and out of an air space of the coil. The coil may have a plurality of distinct layers or distinct coils and a plurality of coil separating members to enable air flow around the coil. Similarly, the frame may include a plurality of spacers to enable air flow around the coil and have a substantially elliptical shape. The preferred device may also have a plurality of magnets positioned adjacent the coil and constrained from movement by the frame.

The present invention may also be summarized as follows: a magnetic field generating device found useful for inhibiting angiogenesis comprising, frame means for supporting a coil of current carrying conductor and enabling airflow over the coil; the frame means further comprises a plurality of panels configured to encourage directional movement of air in association with the coil in order to remove heat from within the frame means and eject it to the outside atmosphere.

The preferred embodiment of the present invention is a cooling system for a magnetic field generating device of the general type described in U.S. Pat. No. 6,007,476, comprising: panel means for directing forced air to flow over a current carrying coil and be expelled from the generating device into the atmosphere.

The invention further includes a frame for supporting a coil of conductor wherein the frame includes a pair of spaced apart side panels configured to allow air to flow into and out of an air space of the coil. The coil of conductor may be comprised of a plurality of distinct layers. The frame preferably includes a plurality of spacers to enable air to flow around the coil, and the coil preferably includes a plurality of coil separating members to enable air to flow around the coil. In addition, at least one of the spaced apart side panels preferably includes a plurality of apertures enabling to air to flow therethrough. A thermocouple device for monitoring the temperature of the coil during use is also preferred.

It is an object of the present invention to provide a complex magnetic field generating device with a supplemental cooling system.

It is an object of the present invention to provide a magnetic field generating device having a frame about which a conductor is wound to form a coil with a supplemental cooling system panel(s).

It is an object of the present invention to provide a magnetic field generating device with a frame assembly with multiple air spaces to allow air circulation in the removal of heat generated by the coil during use.

It is an object of the present invention to provide a coil associated with a magnetic field generating device with a plurality of coil separating members to enable the layers of the conductor to be separated one from another.

It is an object of the present invention to provide a magnetic field generating device with a plurality of panels, each of which is configured to facilitate air flow within the apparatus and expel the heat generated inside the apparatus by the coil.

It is an object of the present invention to provide a magnetic field generating device with a plurality of spacers to maintain the coil in a centered position with respect to the frame.

It is an object of the present invention to provide a coil with a plurality of air spaces through and into which air may pass and flow to remove heat generated by the coil.

These and other objects, features, and advantages shall become apparent after consideration of the scope of the specification, drawings, and claims provided herein. All such objects, features, and advantages are believed to comprise a portion of the present invention in and thus are contemplated within the scope of the present invention even though not specifically set forth in this document.

DETAILED DESCRIPTION OF THE PREFERRED EMBODIMENTS

Figures 1, 2, 3:
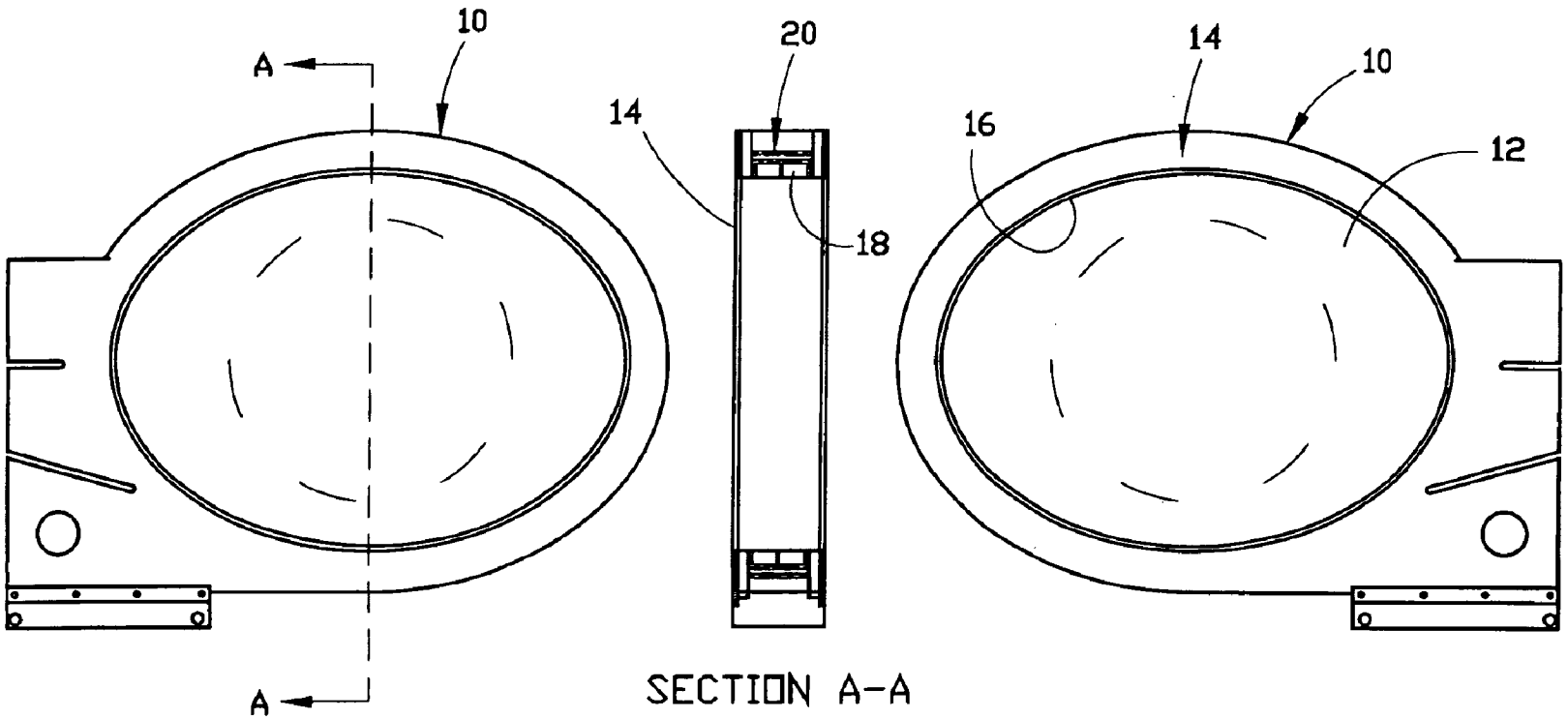
FIGS. 1 and 2 are front and back views of an embodiment of the present invention.
FIG. 3 is an end view of the embodiment of the present invention shown in FIGS. 1 and 2.

With reference to FIGS. 1 through 3, an embodiment of the present invention is designated generally by the reference numeral 10. Embodiment 10 includes a central passageway 12, a frame assembly designated generally by the reference numeral 14, a frame interior 16 onto which a plurality of permanent magnets 18 are positioned in side-by-side axis parallel relationship and conductor 20 is wound to form a coil. It should be noted that the permanent magnets 18 are optional and may be excluded from an operable embodiment of the present invention. In addition, the permanent magnets may be in place in position and the coil 20 eliminated to provide a suitable embodiment of the present invention. However, with respect to the heat removal characteristics, the heat removal problems to which the supplementary cooling system described herein below is provided mainly to remove the heat generated by the coil 20 during operation.

Figure 5:
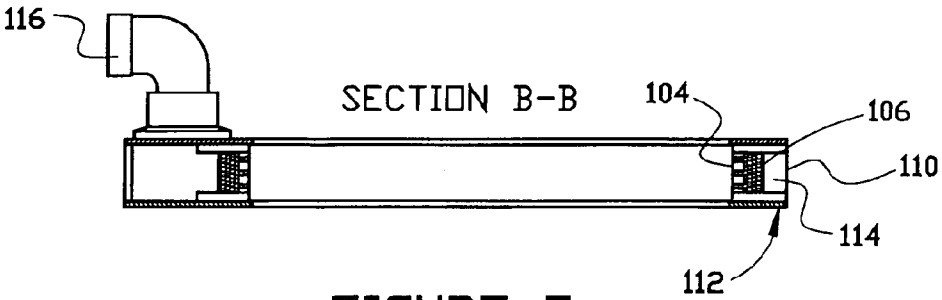
FIG. 5 is a top view of the embodiment shown in FIG. 4.
Figure 6:
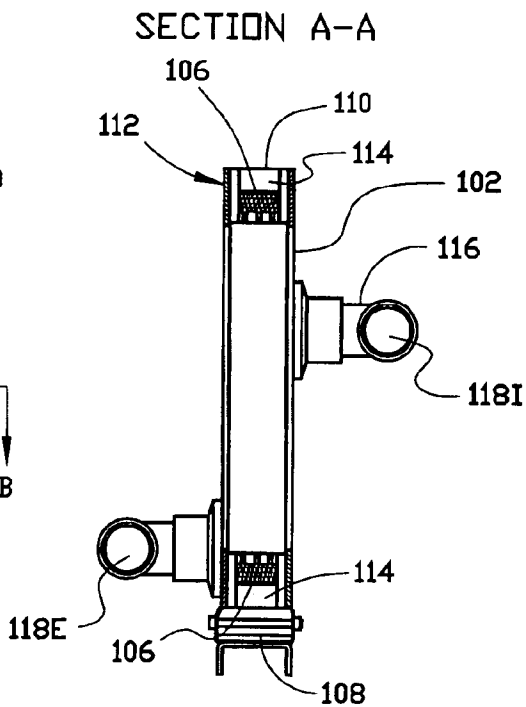
FIG. 6 is a side view of the embodiment shown in FIG. 4.
Figure 4:
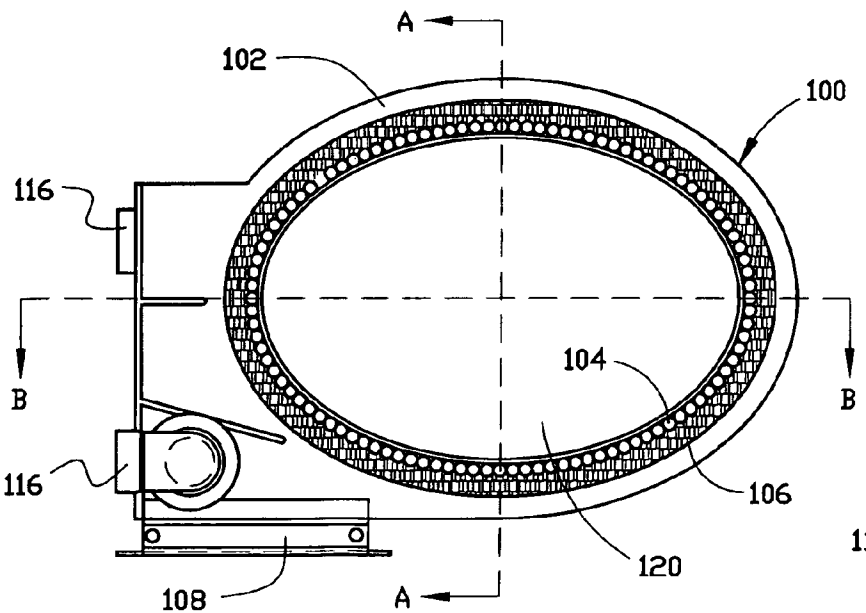
FIG. 4 is a front view of an alternate embodiment of the present invention having airflow ducts associated therewith.

With reference to FIGS. 4 through 6, an alternate embodiment of the present invention is shown including airflow ducts 116 attached to a base support member 108. Accordingly, with respect to this embodiment, it may be designated generally by the reference numeral 100 and include a frame 102, a plurality of permanent magnets 104, and coil 106 wound about the frame 102. Support 108 attaches the frame to any suitable elevating structure in order to hold the apparatus 100 in proper alignment during use. Cover 110 is provided to shield the user from contacting the coil 106 and therefore establishes a connection with the frame 102 at position 112. Airspace 114 is provided to allow air flowing into the ducts 116 via the inlet 118*i* and exit 118*e*. It should be noted that the position of the inlet and exit may be interchangeable depending upon the orientation of the embodiment itself.

Figure 7A:
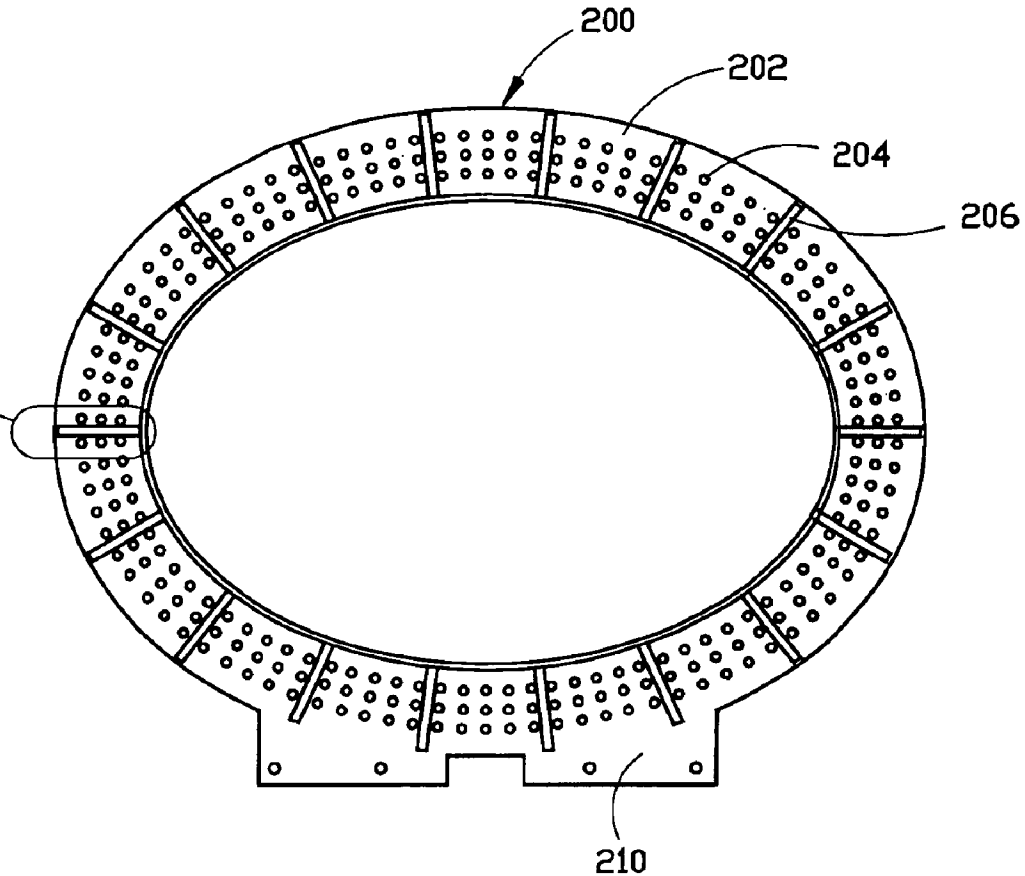
FIG. 7A is a side view of the perforated panel portion of the preferred embodiment of the present invention.
Figure 8:
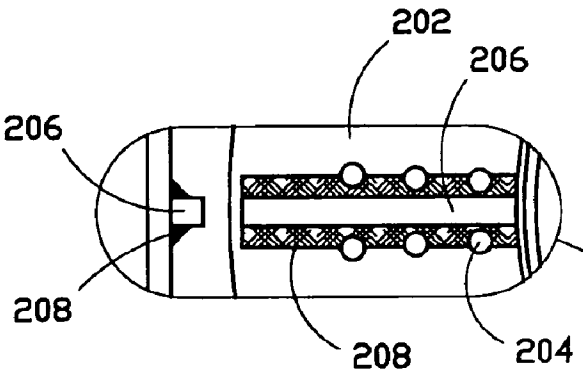
FIG. 8 is a fragmentary isolated perspective view of a portion of FIG. 7A and showing a spacer associated with the perforated panel of FIG. 7A or 7B.
Figures 7B, 9B, 11:
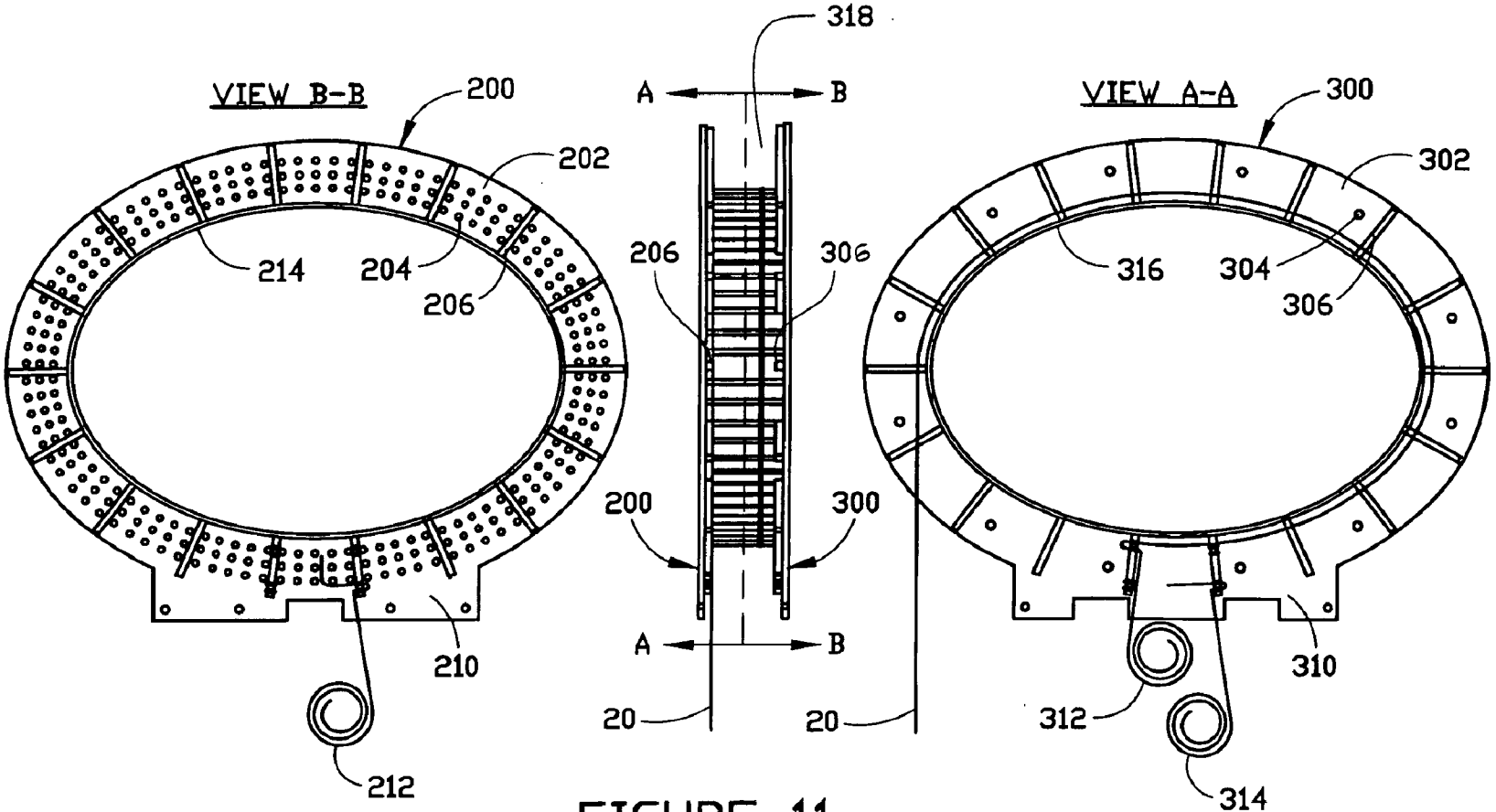
FIG. 7B is a side view of a perforated panel much like that shown in FIG. 7A, but including a thermocouple attached thereto.
FIG. 9B is a side view of the non-perforated panel much like that shown in FIG. 9A, also including the opposing ends of the coil component of the preferred embodiment of the present invention.
FIG. 11 is a side view of the panels of FIGS. 7B and 9B joined together in operative alignment.

Turning now to FIGS. 7A, 7B, 8, 9A, 9B, 10, and 11, the preferred embodiment of the present invention is illustrated. With reference to FIGS. 7A and 7B, the preferred embodiment of the present invention includes preferably a perforated plate designated generally by the reference numeral 200. The perforated plate 200 includes opposing side surfaces 202 (only one of which is seen in the figure), a plurality of perforations or apertures 204 to enable air flow as will be described herein below, and a plurality of spacers 206 rigidly attached to the surface 202 of the perforated panel 200.

The spacers 206 may be attached and secured to the surface 202 of the perforated panel in any suitable means, but epoxy resin or adhesive bonding is preferred as is illustrated in FIG. 8 and designated generally as 208 associated with the adhesive or bonding agent. With reference to FIGS. 7A and 7B, 9A and 9B, the various embodiments include a base portion 210 and 310 and therefore its orientation differs slightly from the embodiments shown in FIGS. 1 through 6.

Figure 9A:
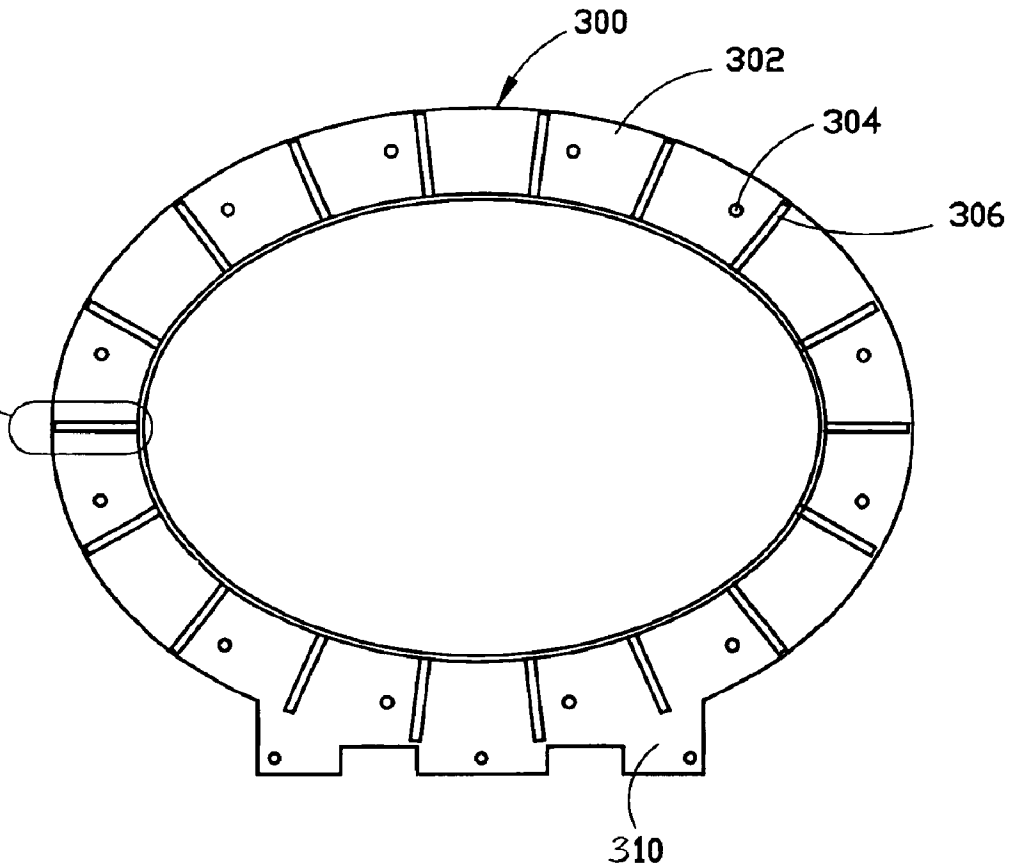
FIG. 9A is a side view of a non-perforated panel associated with the preferred embodiment of the present invention.

With reference to FIGS. 9A and 9B, a non-perforated panel designated generally by the reference numeral 300 in the FIGS. While this panel 300 is generally referred to as a non-perforated panel, it, too, may include a series of perforations, and the naming convention is chosen for ease of clarity and orientation purposes as will be described herein below. With reference to FIGS. 9A and 9B, the non-perforated panel 300 includes opposing side surfaces 302 (only one of which is shown in the figure) and a plurality of apertures 304 as well as spacers 306 attached to the surface 302 of the panel 300.

Figure 10:
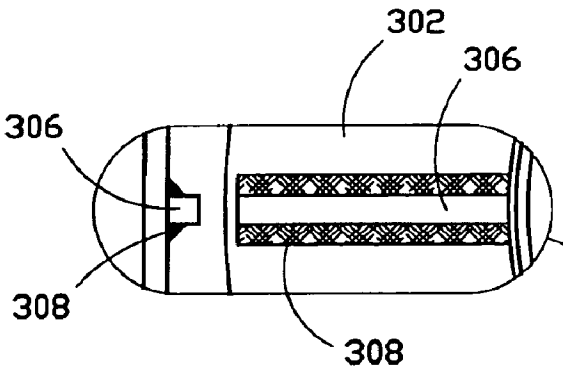
FIG. 10 is a fragmentary isolated perspective view of a spacer component associated with the panel of FIG. 9A or 9B.

With reference to FIG. 10 the spacers 306 are, like the spacers associated with the perforated panel 200, preferably affixed to the inside surface by any conventional means such as epoxy, resin-based adhesives or other suitable bonding agent designated generally by the reference numeral 308. Base 310 has a configuration which differs from the base 210 in combination. There are a variety of configurations of the base which are suitable and the two shown and designated as 210 and 310 respectively are suitable to achieve the desired purpose.

With reference to FIGS. 7B, 9B, and 11, the perforated panel designated generally as 200 is shown beside the non-perforated panel designated generally as 300. Either of which or each of which may include a perpendicular coil-supporting platform 214 or 316 to enable a coil 20 to be wound thereabout and supported thereby (please see FIG. 11) during use.

In its assembled form, as best shown from the side view of FIG. 11, the perforated panel 200 is joined to the non-perforated panel 300 and the plurality of spacers 206 and 306 maintain the coil 20 in appropriate centered alignment with respect to the panels 200 and 300. Once the coil 20 is wound about the frame, partially comprising panels 200 and 300, the coil underlies an airspace 318 which will be useful as described herein below to effectuate the proper airflow through the coil and the overall apparatus.

Figure 14:
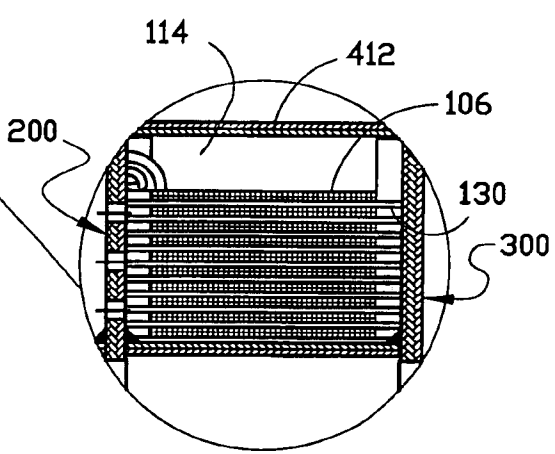
FIG. 14 is an enlarged fragmentary perspective view taken along line A—A of FIG. 12 and exhibiting the various panels and coil in preferred operative arrangement and specifically showing the coil separating members interpositioned between the would layers of the coil of the preferred embodiment of the present invention.
Figure 13:
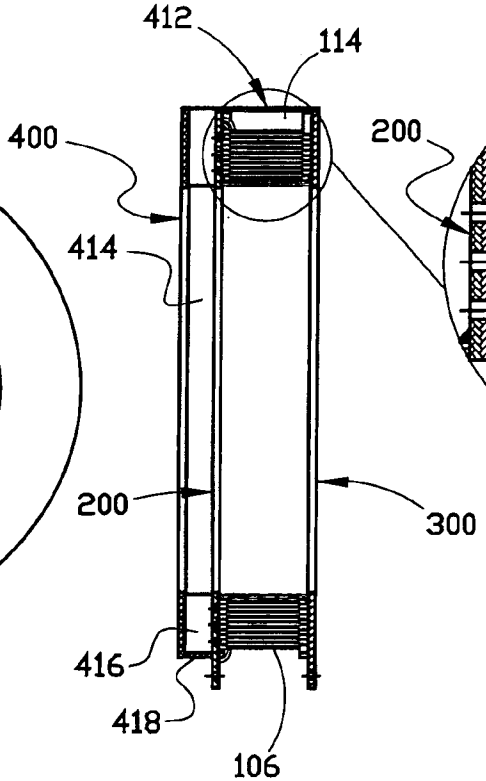
FIG. 13 is an elevated cross-sectional perspective view of a portion of FIG. 12.
Figure 12:
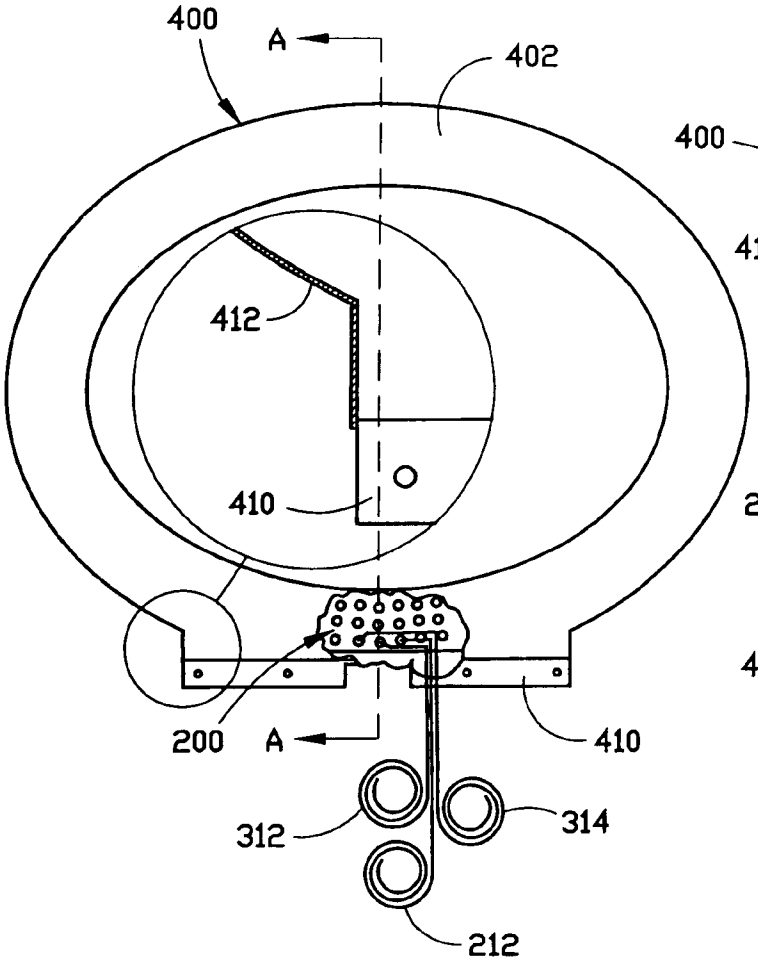
FIG. 12 is a side view of the supplementary cooling system panel of the preferred embodiment of the present invention.

FIGS. 12, 13, and 14 are preferably provided as illustrations of the manner in which air flows into and out of the completed apparatus as well as illustrates the function of the supplementary cooling panel 400 as will be described herein.

With reference to FIG. 12, the supplemental cooling panel designated generally by the reference numeral 400 includes spaced-apart opposing surfaces 402 (only one of which is visible in the figure) and a radiused outer cover surface 412 with overlies and adjoins the supplemental panel to the perforated panel 200 as visible in FIG. 13. The base 410 is associated with the supplemental cooling panel 400 as well as the perforated panel 200 as also shown in FIG. 13. This arrangement is by convenience only and each separate panel may include its own base.

With reference to FIGS. 13 and 14, and passing mention that the thermocouple connection 212 and conductor connections 312 and 314 of FIG. 12 have been eliminated from FIGS. 13 and 14 for convenience, but it should be understood that the conductor ends 312 and 314 are part of the continuous coil winding illustrated in FIGS. 13 and 14.

In a preferred embodiment of the present invention hereof, it is possible to provide a plurality of coil windings and to replace a single coil winding with a plurality of individual coils to achieve the same overall intended purpose.

Turning now to FIGS. 13 and 14, the perforated panel and non-perforated panels 200 and 300 respectively are shown together in proper orientation to enable a coil 106 to be wound around the frame which comprises the combination of at least the two aforementioned panels. An air space 114 overlies the coil 106 and is covered and enclosed by raceway cover 412. With reference to FIG. 14, a plurality of coil separating members 130 are interpositioned between adjacent layers of the coil 106 to provide an efficient means by which air can flow between the layers of the coil and extract the heat associated therewith.

As shown in FIG. 13, supplemental cooling panel 400 is attached and secured to the perforated panel 200 and establishes its own airspace 414 thereby enabling air flow within the airspace 114 and flowing between the adjacent layers of coil 106 by virtue of the coil separating members 130 maintaining a separation distance therebetween to exit through the apertures 204 and enter the air space 414 before it is eliminated through the exit chamber 416 and exit orifice 418.

These and other embodiment of the present invention shall become apparent after consideration of the scope of the disclosure provided herein as well as the claims and drawings attached hereto. All such embodiments and alternates thereof are contemplated within the scope of the present invention even though not specifically set forth herein.

What is claimed is:

1. A magnetic field generating device comprising:

means for producing a magnetic field, wherein the means includes:

a frame having a central passageway, said frame comprising a pair of spaced apart side panels configured to allow air to flow into and out of an air space adjacent to a coil made of electrically conducting material wrapped about the frame and surrounding the central passageway;

a source of electrical energy for supplying an electrical current to the conducting material to create a magnetic field therefrom; and cooling means for cooling the coil during use, said cooling means comprising a plurality of perforations in at least one of the pair of spaced apart side panels, said plurality of perforations being located throughout substantially the entire at least one of the pair of spaced apart side panels and in close proximity to the coil.

2. The device of claim 1, further comprising:

a plurality of spacers located between the pair of spaced apart side panels and the coil to enable air flow around the coil.

3. The device of claim 1 wherein the coil is comprised of a plurality of distinct layers and a plurality of coil separating members located between the plurality of distinct layers of the coil to enable air flow between the distinct layers of the coil.

4. The device of claim 1 wherein the frame has a substantially elliptical shape.

5. The device of claim 1, further comprising:

a plurality of magnets positioned adjacent to the coil and constrained from movement by the frame.

6. The device of claim 1, further comprising:

a supplementary cooling system that is attached to the at least one of the pair of spaced apart side panels having the plurality of perforations.

7. The device of claim 1 wherein airflow is introduced into the air space adjacent to the coil.

8. The device of claim 1 wherein airflow is introduced into the air space adjacent to the coil through the plurality of perforations in the at least one of the pair of spaced apart panels having the plurality of perforations.

9. The device of claim 6 wherein airflow is introduced into the air space adjacent to the coil through the supplementary cooling system.

10. A cooling system for a magnetic field generating device, said magnetic field generating device having a current carrying coil, said cooling system comprising:

a frame for supporting the current carrying coil;

a panel comprising a pair of spaced apart side panels, at least one of said pair of spaced apart side panels having a plurality of perforations for allowing air to flow into an air space adjacent to the current carrying coil and from the generating device into the atmosphere, said plurality of perforations being located throughout substantially the entire at least one of said pair of spaced apart side panels and in close proximity to the coil; and a supplementary cooling system that is attached to the at least one of said pair of spaced apart side panels including the plurality of perforations.

11. The device of claim 10 wherein airflow is introduced into the air space adjacent to the coil through the supplementary cooling system.

* * * * *